United States Patent [19]

Sorensen

[11] Patent Number: 4,785,946

[45] Date of Patent: Nov. 22, 1988

[54] GONDOLA MERCHANDISING DISPLAY SYSTEM

[75] Inventor: Gerald R. Sorensen, Elgin, Ill.

[73] Assignee: National Creative Merchandising Corp., Arlington Heights, Ill.

[21] Appl. No.: 915,242

[22] Filed: Oct. 3, 1986

[51] Int. Cl.[4] ..... A47F 5/00

[52] U.S. Cl. ..... 211/187; 211/87; 211/189; 248/222.2; 248/225.1

[58] Field of Search ..... 211/189, 87, 90, 169, 211/199, 175; 248/220.2, 225.1, 222.2, 221.2

[56] References Cited

U.S. PATENT DOCUMENTS

| | | | |
|---|---|---|---|
| 3,112,912 | 12/1963 | Alvarez | 248/221.2 |
| 3,314,551 | 4/1967 | Plastow | 211/199 |
| 3,866,364 | 2/1975 | Pollard | 52/36 |
| 4,133,433 | 1/1979 | Wolf | 211/192 |
| 4,323,163 | 4/1982 | Johns | 211/189 |
| 4,508,231 | 4/1985 | Honickman | 211/199 |
| 4,531,331 | 7/1985 | Itagaki | 211/189 X |
| 4,579,308 | 4/1986 | Jensen | 248/225.1 |
| 4,610,560 | 9/1986 | Miller | 211/189 X |
| 4,694,965 | 9/1987 | Parnell | 211/189 X |
| 4,696,407 | 9/1987 | Franklin | 248/220.3 X |

*Primary Examiner*—Robert W. Gibson, Jr.

*Attorney, Agent, or Firm*—Wallenstein, Wagner, Hattis & Strampel, Ltd.

[57] ABSTRACT

Unique structural members for retail merchandising display, especially gondola shelving displays comprising an elongated framing extrusion being generally I-shaped in transverse profile to define two parallel longitudinal channels, an elongated linking/framing extrusion having a longitudinal channel along one side and on an other side a curved grasping arm parallel to a like curved hinging arm, and a merchandising display component support extrusion having a plurality of vertically aligned and stacked generally L-shaped longitudinal channels.

11 Claims, 5 Drawing Sheets

GONDOLA MERCHANDISING DISPLAY SYSTEM

DESCRIPTION

Technical Field of the Invention

The present invention generally relates to the structure and construction of modular retail merchandising displays and, in particular, to a structural system for constructing variable configuration gondola shelving displays utilizing uniquely configured structural extrusions.

BACKGROUND OF THE INVENTION

Merchandising displays in self-service retail stores require the use of merchandising displays which allow an unobstructed view of the goods, easy removal and replacement of goods on the display and the capability of storing a limited inventory of goods on the display to limit the frequency of display restocking. One of the most popular merchandising displays for self-service retailing establishments which meets these needs is gondola shelving. Commonly used in modern retailing environments, gondola shelving systems include open-faced and open-sided shelving units suspended at one edge from a free-standing, upright support assembly. Gondola shelving systems afforded consumers a clear view of the goods and are approachable from at least three sides. Further, gondola shelves are wide enough to carry a limited inventory of goods. In addition, gondola shelving systems can be arranged in a back-to-back fashion to maximize the quantity of goods displayed even on retailing floors.

However, a disadvantage of many prior art retail merchandising displays such as gondola shelving, is that many such displays are permanent installations and cannot be easily rearranged into various configurations as required by the changing needs of self-service retail stores.

The prior art has addressed the lack of flexibility and versatility of such retail merchandising displays by suggesting the use of modular merchandising displays. Such modular displays are comprised of various components which can be linked together to form multiple configuration merchandising displays. A typical element of such modular merchandising displays are metal extrusions which are used as a structural member in constructing the displays. Examples of prior art displays may be seen in U.S. Pat. Nos. 3,866,364; 4,133,433;and, 4,579,308.

A disadvantage of such prior art modular merchandising displays is that such displays include the use of numerous components and parts and a large number of fasteners such as nuts, bolts and clamps. As a result, such prior art modular displays are not easily disassembled and reassembled to accommodate the needs of modern, self-service retailing.

Hence, prior to the development of the present invention, a need existed for a simplified modular merchandising display system for gondola shelving and other displays which minimize the number of components and fasteners required for assembling and disassembling the display.

In addition, a need also existed for a simplified modular merchandising display system for gondola shelving capable of being arranged in various display configurations.

Also, a need existed for a simplified, modular merchandising display system for gondola shelving utilizing structural extrusions having unique configurations so as to perform a variety of support and structural functions.

SUMMARY OF THE INVENTION

According to the present invention, a unique merchandising display has been developed for gondola shelving and other types of self-service retailing displays utilizing a minimum of components and fasteners to permit easy assembly and disassembly of the display. Yet, the present invention provides maximum flexibility to create a multitude of display configurations.

Generally, the modular merchandising display of the present invention utilizes three uniquely configured structural extrusions preferably extruded from lightweight aluminum having a high degree of tensile strength. Each extrusion performs at least one function in creating the merchandising display. In some instances an extrusion may perform more than one function.

Specifically, one elongate structural extrusion preferably has a generally I-shaped transverse profile defining longitudinal side channels for receiving and releasably coupling together display components such as gondola shelves, shelf spacer panels and display bases as well as releasably interlocking with portions of the other structural extrusions. In preferred embodiments of the present invention, the I-shaped extrusion performs a framing and structural support function in the merchandising display through use as a vertical or horizontal support of peripheral edges of display components or utilized as an end piece or in-line connection.

A second elongate structural extrusion of the present invention performs a combination of functions. In transverse profile, the second extrusion includes on one side, an elongated longitudinal channel similar to the longitudinal channels formed in the I-shaped framing extrusion. An other side of the second extrusion includes two parallel and inwardly curving longitudinal arms, one arm having a free terminal end and an other arm having an enlarged terminal end to define a hinging pivot. The one arm of the second extrusion grasps about and around the hinging pivot of the other arm of an adjacent second extrusion to effect the releasable linking of two second extrusions.

As a result of such unique configuration, the second extrusion performs both framing through use of the longitudinal channel and linking functions through use of the grasping and hinging arms. Further, because the hinging pivot has a rounded configuration, the grasping arm of one second extrusion may link with the hinging arm of an adjacent or second extrusion, a variety of angular linkage modes ranging from an aligned orientation to a perpendicular orientation.

Finally, the present invention includes a third elongated structural extrusion comprising an aligned, vertical stack of longitudinal L-shaped channels. In a preferred embodiment of the third extrusion, four L-shaped channels are utilized in which two of such channels are directed to each side of the third extrusion. Preferably an uppermost L-shaped channel is opened to one side of the third extrusion while a second L-shaped channel positioned below and aligned with the uppermost channel opens to an other side of the third extrusion. A third L-shaped channel, preferably aligned with and below the second L-shaped channel again opens to the one side of the third extrusion. A bottommost L-shaped channel aligned with and below the third L-shaped channel opens to the other side of the third extrusion.

Such L-shaped channels may be used to receive ortions of gondola shelves, books or hangers as well as shelf spacer panels, shelf bases and signage panels. As a result, the third extrusion performs display component support functions in modular merchandising display systems.

Finally, in a preferred embodiment of the third or, component support extrusion, an additional upwardly directed longitudinal channel is provided on the topside of the third extrusion. Likewise, a downwardly directed longitudinal channel is provided on the bottom side of the third extrusion. The topside and bottom side longitudinal channels permit the third extrusion to also receive end portions of spacer panels and signage panels as well as permitting several third extrusions to be vertically stacked.

Other advantages and aspects of the invention will become apparent upon making reference to the specification, claims, and drawings to follow.

DETAILED DESCRIPTION OF THE INVENTION

Figure 1:
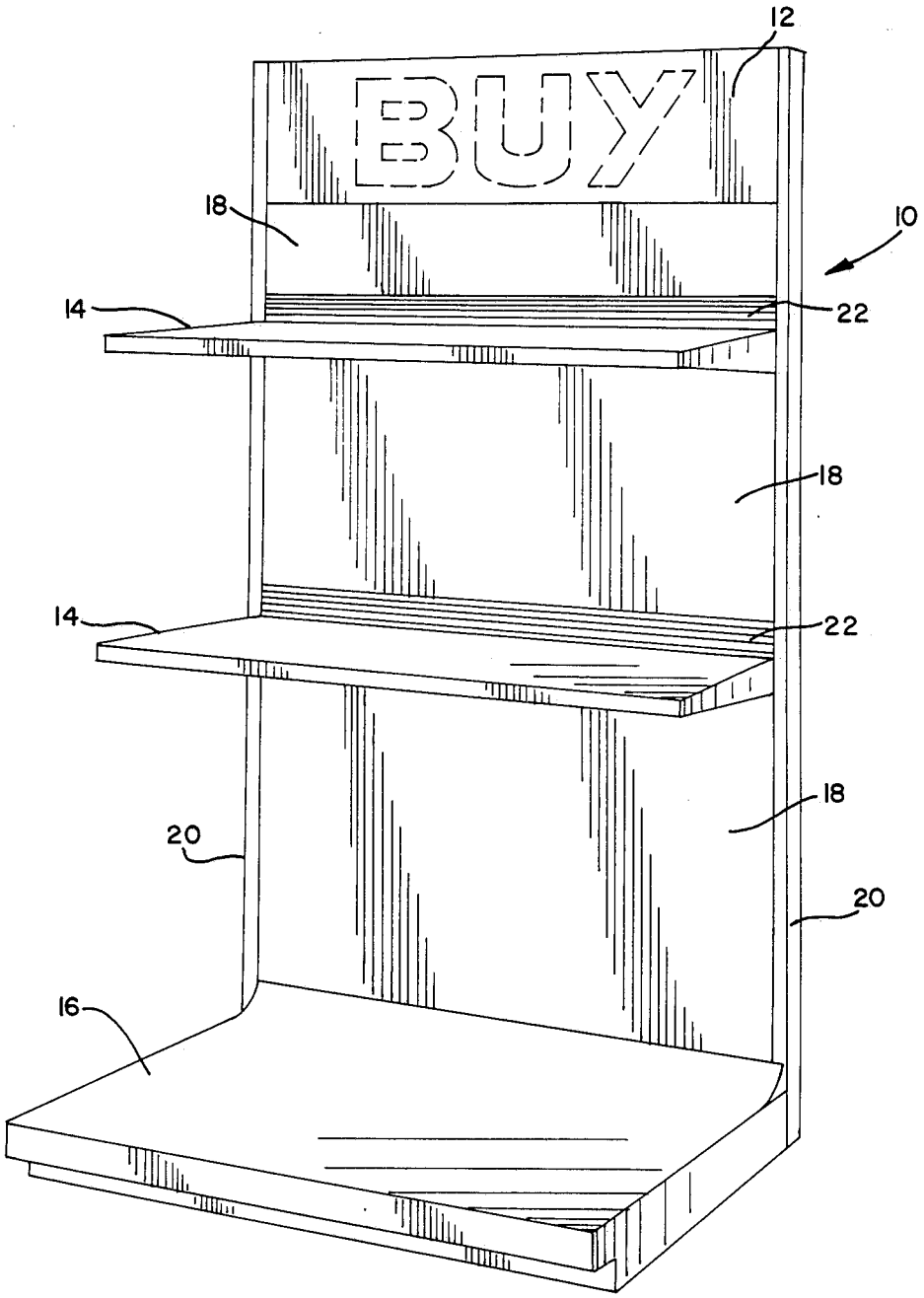
FIG. 1 is a perspective view of one embodiment of a gondola shelving unit utilizing the structural extrusions of the present invention.
Figure 2:
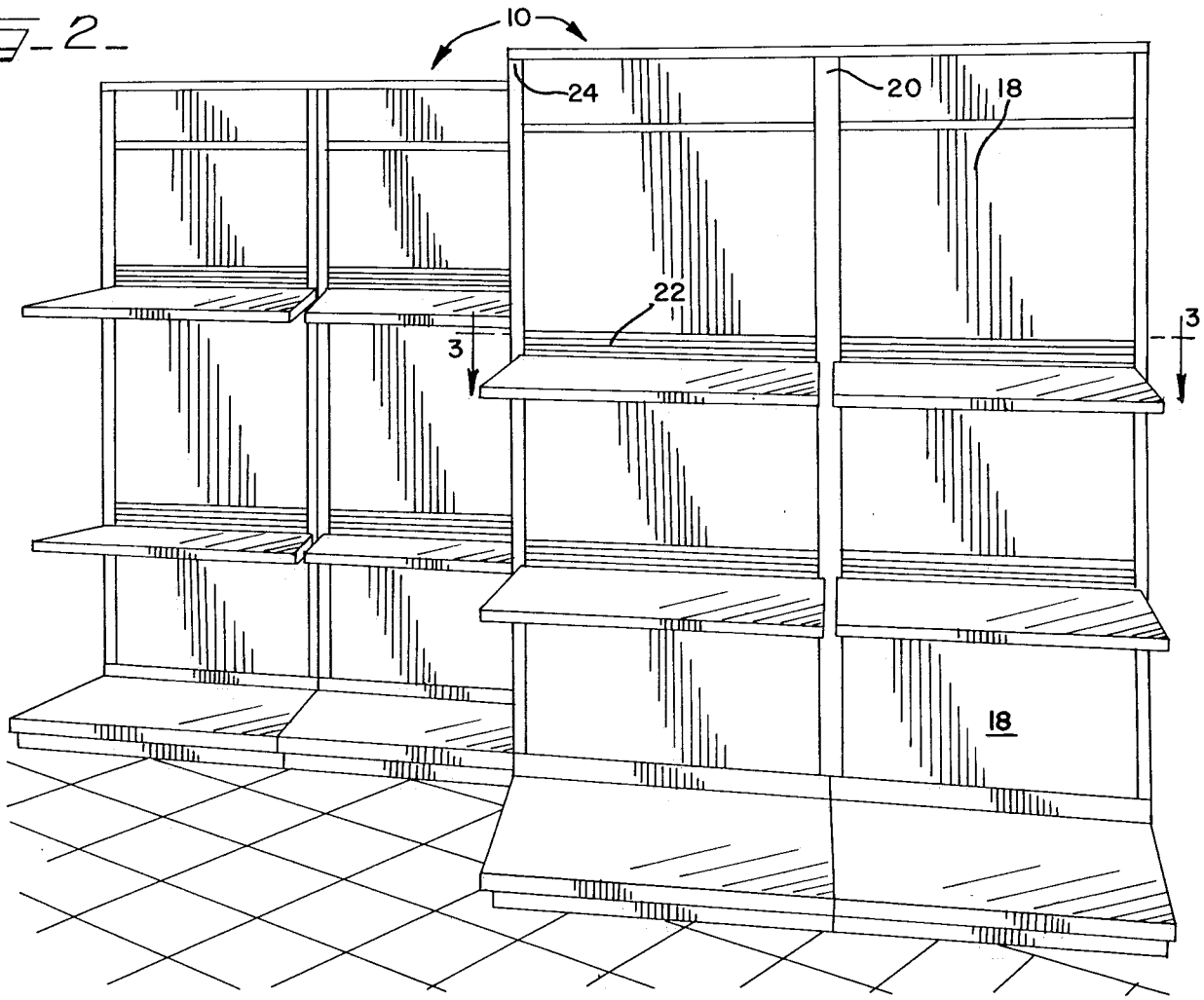
FIG. 2 illustrates a self-service retail store layout using the structural extrusions of the present invention to link several merchandise gondolas.

Referring now to the drawings, FIGS. 1 and 2 disclose gondola shelving units 10 constructed from various display components and assembled through use of three uniquely configured structural extrusions. The principal display components of the gondola shelving merchandising system of the present invention include a signage panel 12, gondola shelves 14, shelf bases 16 and shelf spacer panels 18. As disclosed in FIGS. 1 and 2, shelf spacer panels 18 have variable heights in order to selectively vertically space apart gondola shelves 14 on units 10.

FIGS. 1 and 2 exemplify the manner in which the three structural extrusions of the present invention are incorporated into gondola shelving units 10. For example, FIG. 1 discloses use of a framing extrusion 20 providing upright vertical support to shelving units 10 and peripherally linking together panels 12 and 18. FIG. 1 further discloses a component support extrusion 22 from which are suspended gondola shelves 14. Component support extrusion 22 is linked to framing extrusion 20 in a manner to be later described in greater detail. FIG. 2 discloses use of a linking/framing extrusion 24 performing both a framing function while also angularly coupling one pair shelving units 10 with an adjacent pair of shelving units 10.

Extrusions 20, 22 and 24 provide the structural support display component suspension and linking of one shelving unit with adjacent shelving units. Extrusions 20, 22 and 24 are extruded from a lightweight metal or alloy having a high tensile strength, preferably aluminum which is easily extruded into the detailed configurations required for extrusions 20, 22 and 24. In addition, by extruding extrusions 20, 22 and 24 from aluminum, retailers can easily cut and miter each extrusion into various lengths and angles.

Figure 8:
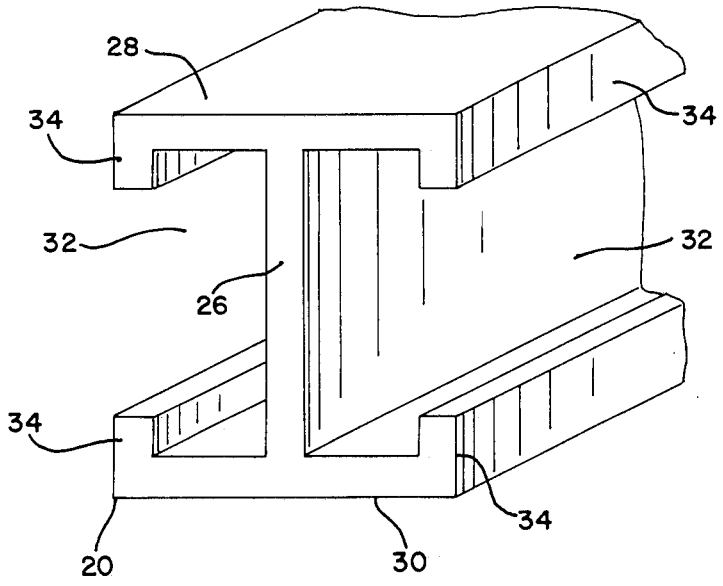
FIG. 8 is an enlarged perspective view of the transverse profile of the framing extrusion.

FIG. 8 discloses the configuration and structure of framing extrusion 20 in greater detail. Preferably, framing extrusion 20 generally has an I-shape in transverse profile as depicted in FIG. 8. A central partition 26 longitudinally bisects framing extrusion 20. Central partition 26, along with an upper partition 28 and a lower partition 30 define two parallel and longitudinal open channels 32. Channels 32 receive portions of panels 12 and 18. As will later be explained, channels 32 of framing extrusion 20 may also receive portions of component support extrusions 22.

Finally, FIG. 8 discloses ends of partition 28 downwardly flanged and ends of partition 30 upwardly flanged to define rims 34. As will be later explained, rims 34 of framing extrusion 20 interlock within corresponding notches carried on component support extrusion 22.

Figure 9:
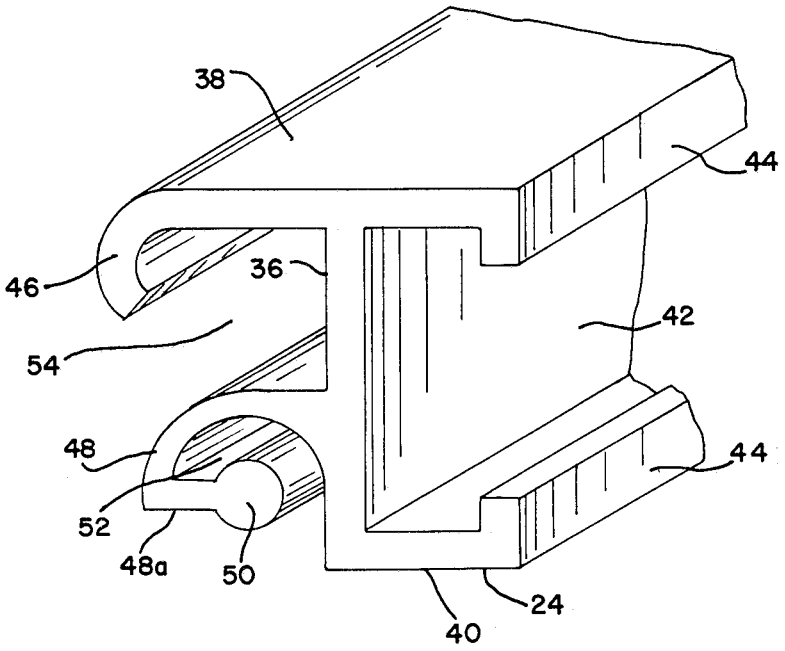
FIG. 9 is an enlarged perspective view of the transverse profile of the linking/framing extrusion.

The unique transverse profile of linking/framing extrusion 24 is shown in FIG. 9. A central partition 36 longitudinally bisects extrusion 24. A full-width upper partition 38 and bottom side partition 40 extending only half the width of extrusion 24 define with central partition 38, a longitudinal channel 42 extending along one side of extrusion 24 identical in inner dimensions to longitudinal channels 32 of framing extrusion 20. Similar to framing extrusion 20, the ends of upper partition 38 downwardly flange to define a rim 44. Likewise, the ends of bottom partition 40 of extrusion 24 upwardly flange to also define a rim 44. As will be later described in greater detail, rims 44 are insertable into corresponding notches on component suspending extrusion 22.

On an other side of linking/framing extrusion 24, upper partition 38 curves downwardly and slightly inwardly to define an arcuate grasping arm 46. Longitudinally parallel with and below grasping arm 46 is a hinging arm 48. Hinging arm 48 extends from a generally intermediate position on central partition 38 and curves downwardly to a position generally parallel to partition 38 as disclosed in FIG. 9. Unlike grasping arm 46 which continues curving inwardly toward central partition 38, hinging arm 48 includes a return portion **48*a* perpendicularly directed to central partition 38. The terminal end of return portion 48*a* is enlargened to define a rounded pivot rod 50. In the preferred embodiment of linking/framing extrusion 24, pivot rod 50 extends the length of extrusion 24. It should be understood that pivot rod 50 need not continuously extend the length of extrusion 24 but may embody discontinuous pivot segments. As will be later explained, such pivot segments are adequate to permit one extrusion 24 to releasably link with an adjacent extrusion 24**.

FIG. 9 further discloses an arcuate longitudinal channel 52 surrounding pivot rod 50. As disclosed in FIGS. 4 through 6, the inner dimensions of arcuate channel 52 are such as to accommodate a grasping arm 46 from an adjacent linking/framing extrusion 24.

Grasping arm 46 defines another longitudinal channel 54. As disclosed in FIGS. 4 through 6, the inner dimensions of longitudinal channel 54 are sufficient to receive and accommodate the hinging arm 48 of another linking/framing extrusion 24.

Figure 7:
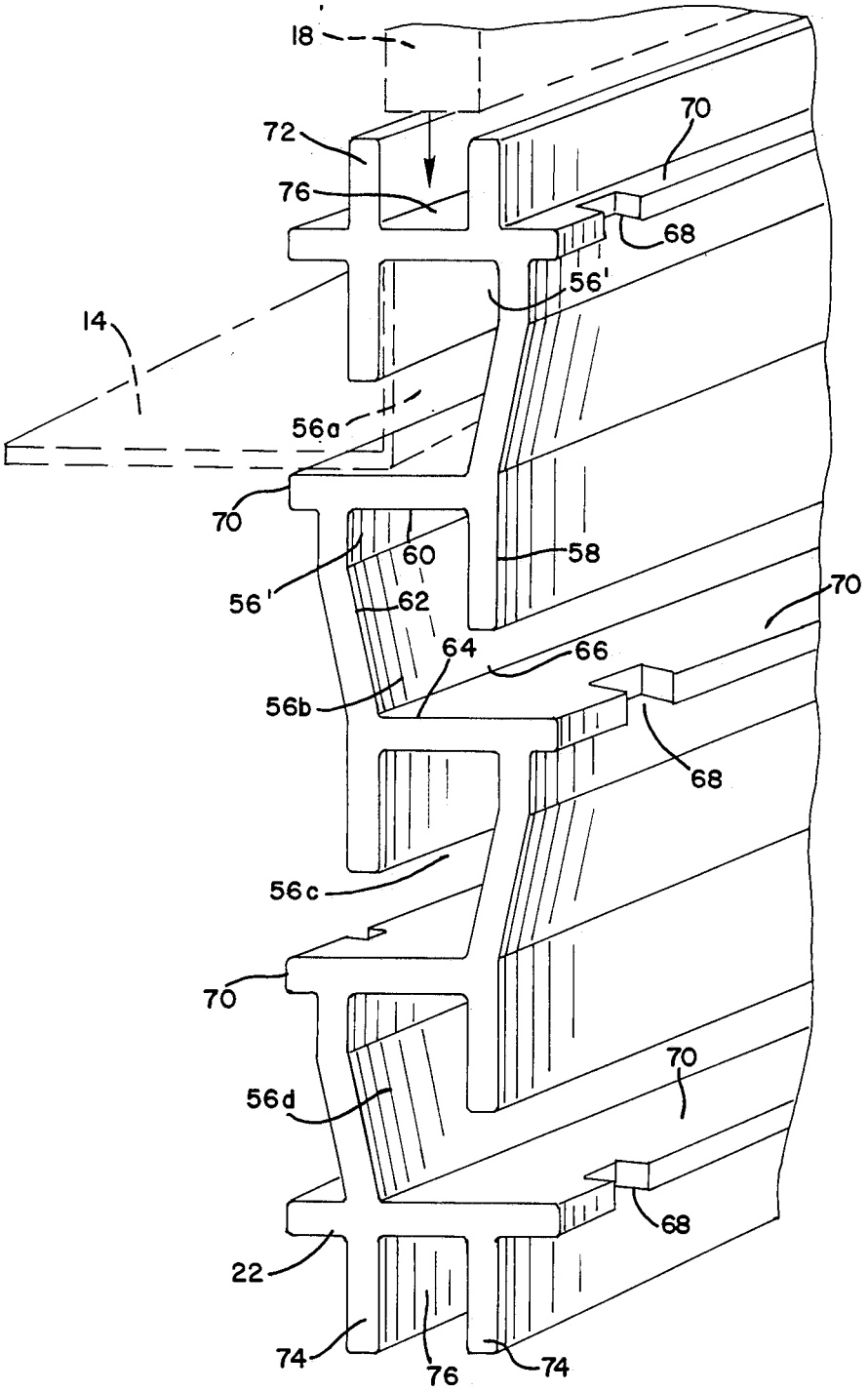
FIG. 7 is an enlarged fragmented perspective view of the transverse profile of the component support extrusion.

A third structural extrusion utilized in the present invention is disclosed in FIG. 7. Component support extrusion 22 in a preferred embodiment, includes four vertically tiered, generally L-shaped longitudinal channels 56. Preferably two of such channels 56 are directed to one side of extrusion 22, while another two of such channels 56 are directed to an other side of extrusion 22. Further, such channels 56 are alternatively arranged such that an uppermost L-shaped channel 56*a* is directed to the one side of extrusion 22 with a second uppermost channel 56*b* directed to the other side of extrusion 22. A third channel 56*c* is again directed to the one side of extrusion 22 while a lowermost L-shaped channel 56*d* is directed toward the other side of extrusion 22. Such alternate staggering of channels 56 allows extrusion 22 to support display components from either side of the extrusion Each L-shaped channel 56 is defined by a front wall 58, a top wall 60, a back wall 62 and a bottom wall 64. The front wall 58 is abbreviated to define an opening 66 as a means of access to L-shaped channel 56.

FIG. 7 also discloses the manner in which extrusion 22 supports a gondola shelf 14 (shown in phantom). A portion of gondola shelf 14 is angled to pass through front opening 66 of channel 56 to seat on bottom wall 64 and abutting against front wall 58. Back wall 62 is slanted back to define a widening 56' of L-shaped channel 56. Widening 56' provides additional clearance to allow for the easy insertion and removal of a gondola shelf 14 within an L-shaped channel 56. It should be understood that as the load carried on gondola shelf 14 increases, front wall 58 and bottom wall 64 will carry such load in supporting shelf 14 within extrusion 22. Front wall 58 functions by retaining gondola shelving within L-shaped channel 56.

Component support extrusions 22 include notches 68 in horizontal partitions 70 to releasably couple extrusion 22 with framing extrusions 20 or linking/framing extrusions 24. As disclosed in FIG. 3 and to be discussed later in greater detail, notches 68 receive rims 34 of framing extrusion 20 and rims 44 of linking/framing extrusion 24.

Finally, the preferred embodiment of extrusion 22 also includes a pair of vertical partitions 72 perpendicularly projecting from an uppermost horizontal partition 70. Likewise, FIG. 7 discloses a pair of downwardly directed vertical partitions 74 perpendicularly projecting from the lowermost horizontal partition 70. Both vertical partitions 72 and 74 are selectivelv spaced to define a U-shaped longitudinal channel 76. Channels 76 are of sufficient inner dimensions to easily accommodate the insertion and removal of a portion of a display component, such as a shelve spacer panel 18 (shown in phantom in FIG. 7) or signage panel 12.

Finally, FIGS. 3 through 6 disclose the manner in which extrusions 20, 22 and 24 releasably interlock and are assembled to create a shelving display unit 10 as illustrated in FIGS. 1 and 2. Specifically, FIG. 3 discloses in transverse section the manner in which rims 34 of extrusions 20 seat within notches 68 of extrusion 22. In order to position and seat support extrusion 22 within framing extrusion 20, extrusion 22 must be brought to an open end of extrusions 20. Next, the ends of support extrusion 22 are passed into and along longitudinal channels 32 of extrusion 20 so that rims 34 seat within notch 68 of support extrusion 22. Upon the seating of rims 34 within notches 68, support extrusion 22 is slid along longitudinal channels 32 until a desirable position. Extrusion 22 need not be secured to extrusion 20 by screws, bolts or other fastening means, but is maintained at the desirable position by insertion of additional spacer panels 18.

Figure 3:
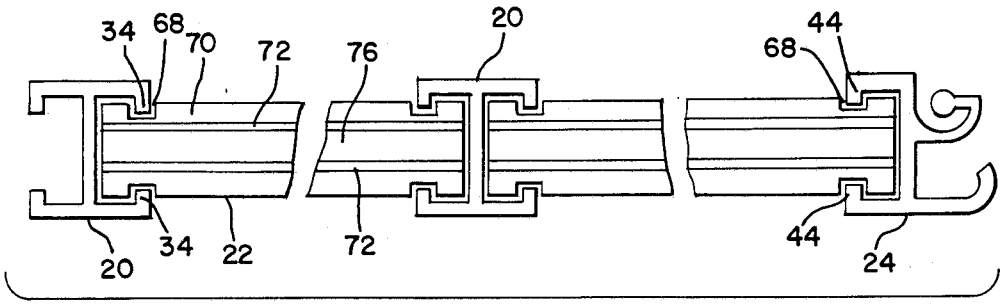
FIG. 3 is a cross-sectional view of linked merchandise gondolas viewed along line 3—3 of FIG. 2.

As shown in FIG. 3, linking/framing extrusion 24 releasably couples with support extrusion 22 in the same manner as extrusion 20. That is, extrusion 22 is passed through longitudinal channel 42 upon seating of rims 44 within notches 68.

Figure 4:
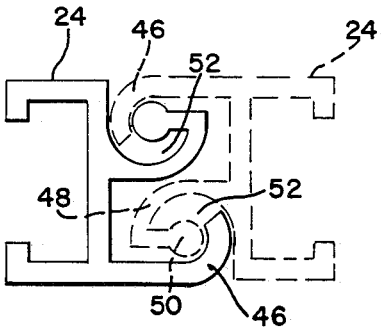
FIG. 4 is a transverse sectional view of the aligned coupling of two linking extrusions.
Figure 5:
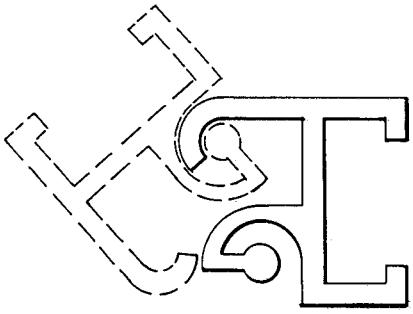
FIG. 5 is a transverse sectional view of an angular linking of two linking extrusions.
Figure 6:
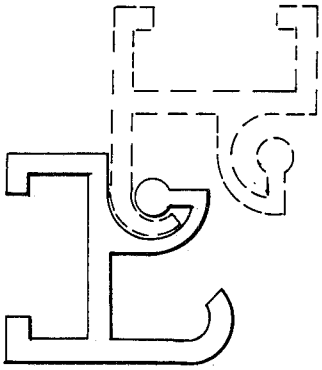
FIG. 6 is a transverse sectional view of a perpendicular linking of two linking extrusions.

Finally, FIGS. 4 through 6 demonstrate the various manners in which two adjacent linking/framing extrusions 24 can be releasably linked and arranged in a variety of angular linkage modes. FIG. 4 discloses one extrusion 24 linked with an adjacent extrusion 24 (shown in phantom) such that the grasping arms 46 of each extrusion 24 are inserted about one-third of the depth into arcuate channel 56. Each grasping arm 46 wraps around and about pivot rod 50. In order to effect an aligned linkage mode of extrusions 24 as disclosed in FIG. 4, it is necessary that one extrusion 24 be first end-to-end mated with the other extrusion 24. The one extrusion 24 is held stationary while the other extrusion 24 is slid along such that hinging arm 48 travels along longitudinal channel 54 and grasping arm 46 travels along longitudinal arcuate channel 52. Aligned linkage of extrusions 24 is completed upon the ends of each extrusion coinciding.

FIG. 5 discloses an angular linkage mode of extrusions 24. In an angular linkage mode, the grasping arm 46 of one extrusion 24 seats within arcuate channel 52 about pivot rod 50. In angular linkage modes of extrusions 24, one grasping arm 46 and hinging arm 48 remain non-engaged. FIG. 6 discloses another angular linking of extrusions 24 in which extrusions 24 are linked in a perpendicular orientation.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. A structural member for merchandising displays, the displays having a plurality of interlocking and engaging gondola shelving display components, comprising:

an elongated component support extrusion for suspending display components, the support extrusion including a single column of vertically stacked generally L-shaped longitudinal channels for receiving portions of display components, the component support extrusion having L-shaped channels opening to one side of said extrusion and L-shaped channels opening to an other side of said extrusion, the elongated component support extrusion having a plurality of vertically aligned notches on the one side and the other side of the extrusion, said notches for receiving portions of other differently configured extrusions.

2. The structural member of claim 1 further including:

an elongated framing extrusion for peripheral edge coupling of display components, the framing extrusion having a vertical partition longitudinally bisecting the framing extrusion into two parallel longitudinal channels, the framing extrusion having a pair of longitudinal horizontal partitions perpendicularly disposed to each side of the vertical partition, longitudinal edges of the horizontal partitions being flanged to define rims for seating within the notches of the component support extrusion.

3. A structural member for merchandising displays, the displays having a plurality of interlocking and engaging gondola shelving display components, comprising:

an elongated component support extrusion for suspending display components, the support extrusion having a plurality of vertically stacked and aligned generally L-shaped longitudinal channels for receiving portions of display components, the component support extrusion having L-shaped channels opening to one side of said extrusion and L-shaped channels opening to an other side of said extrusion;

the elongated component support extrusion having a plurality of vertically aligned notches on the one side and the other side of the extrusion, said notches for receiving portions of other differently configured extrusions;

an elongated framing extrusion for peripheral edge coupling of display components, the framing extrusion having a vertical partition longitudinally bisecting the framing extrusion into two parallel longitudinal channels, the framing extrusion having a pair of longitudinal horizontal partitions perpendicularly disposed to each side of the vertical partition, longitudinal edges of the horizontal partitions being flanged to define rims for setting within the notches of the component support extrusion;

an elongated linking/framing extrusion for peripheral edge coupling of display components and releasably linking with adjacent extrusions, said linking/framing extrusion having a vertical partition longitudinally bisecting said extrusion to define an open longitudinal channel on one side of said vertical partition;

an other side of the vertical partition having a hinging arm projecting from said vertical partition, the hinging arm curving toward a terminal edge, at least portions of the terminal edge carrying enlarged rounded pivot segments; and, a grasping arm being perpendicularly disposed to the vertical partition and on the other side of the vertical partition, the grasping arm longitudinally parallel with the hinging arm curving toward the hinging arm, such that the grasping arm of one linking extrusion may be inserted around and about the pivot segment of the hinging arm of an adjacent linking extrusion coupling the one extrusion with the adjacent extrusion.

4. A structural member for merchandising displays, the displays having a plurality of interlocking and engaging gondola shelving display components, comprising:

an elongated component support extrusion for suspending display components, the support extrusion having a plurality of vertically stacked and aligned generally L-shaped longitudinal channels for receiving portions of display components, the component support extrusion having L-shaped channels opening to one side of said extrusion and L-shaped channels opening to an other side of said extrusion;

the elongated component support extrusion having a plurality of vertically aligned notches on the one side and the other side of the extrusion, said notches for receiving portions of other differently configured extrusions;

an elongated linking/framing extrusion for peripheral edge coupling of display components and releasably linking with adjacent extrusions, said linking/framing extrusion having a vertical partition longitudinally bisecting said extrusion to define an open longitudinal channel on one side of said vertical partition;

an other side of the vertical partition having a hinging arm projecting from said vertical partition, the hinging arm curving toward a terminal edge, at least portions of the terminal edge carrying enlarged rounded pivot segments; and, a grasping arm being perpendicularly disposed to the vertical partition and on the other side of the vertical partition, the grasping arm longitudinally parallel with the hinging arm curving toward the hinging arm, such that the grasping arm of one linking extrusion may be inserted around and about the pivot segment of the hinging arm of an adjacent linking extrusion coupling the one extrusion with the adjacent extrusion.

5. A structural member for merchandising displays, the displays having a plurality of interlocking and engaging gondola shelving display components, comprising:

an elongated component support extrusion including a single column of vertically stacked generally L-shaped longitudinal channels, each L-shaped channel including a horizontal channel joined to a vertical channel for receiving portions of display components, each L-shaped channel being accessible through the horizontal channel;

the horizontal channels of the L-shaped channels alternately opening from one side of the extrusion to an other side of the extrusion;

each horizontal channel being defined by at least a horizontal partition having a peripheral edge notch to receive portions of other differently configured extrusions; and, a topside surface and a bottom side surface of the extrusion having elongated generally U-shaped channels for receiving edges of display components.

6. The structural member of claim 5 wherein the peripheral edge notches for each horizontal partition are vertically aligned.

7. The structural member of claim 5 wherein the singular column of vertically stacked L-shaped channels includes four L-shaped channels.

8. The structural member of claim 5 wherein an upper portion of each vertical channel of the L-shaped channels has inner dimensions larger than the inner dimensions of a lower portion of each vertical channel.

9. The structural member of claim 5 further including:

an elongated framing extrusion for peripheral edge coupling of display components, the framing extrusion having a vertical partition longitudinally bisecting the framing extrusion into two parallel longitudinal channels, the framing extrusion having a pair of longitudinal horizontal partitions perpendicularly disposed to each side of the vertical partition, longitudinal edges of the partitions being flanged to define rims for seating within the notches of the component support extrusion.

10. The structural member of claim 9 further including:

an elongated linking/framing extrusion for peripheral edge coupling of display components and releasably linking with adjacent extrusions, said linking/-framing extrusion having a vertical partition longitudinally bisecting said extrusion to define an open longitudinal channel on one side of said vertical partition, an other side of the vertical partition having a hinging arm projecting from said vertical partition, the hinging arm curving toward a terminal edge, at least portions of terminal edge carrying enlarged rounded pivot segments, a grasping arm being perpendicularly disposed to the vertical partition and on the other side of the vertical partition, the grasping arm longitudinally parallel with the hinging arm curving toward the hinging arm, such that the grasping arm of one linking extrusion may be inserted around and about the pivot segment of the hinging arm of an adjacent linking extrusion coupling the one extrusion with the adjacent extrusion.

11. The structural member of claim 5 further including:

an elongated linking/framing extrusion for peripheral edge coupling of display components and releasably linking with adjacent extrusions, said linking/-framing extrusion having a vertical partition longitudinally bisecting said extrusion to define an open longitudinal channel on one side of said vertical partition, an other side of the vertical partition having a hinging arm projecting from said vertical partition, the hinging arm curving toward a terminal edge, at least portions of terminal edge carrying enlarged rounded pivot segments, a grasping arm being perpendicularly disposed to the vertical partition and on the other side of the vertical partition, the grasping arm longitudinally parallel with the hinging arm curving toward the hinging arm, such that the grasping arm of one linking extrusion may be inserted around and about the pivot segment of the hinging arm of an adjacent linking extrusion coupling the one extrusion with the adjacent extrusion.

* * * * *

UNITED STATES PATENT AND TRADEMARK OFFICE

CERTIFICATE OF CORRECTION

PATENT NO. : 4,785,946

DATED : November 22, 1988

INVENTOR(S) : Gerald R. Sorensen

It is certified that error appears in the above-identified patent and that said Letters Patent is hereby corrected as shown below:

In Claim 3, Column 7, line 39, delete "setting" and insert therefor --seating--

Signed and Sealed this

Twenty-eighth Day of March, 1989

*Attest:*

DONALD J. QUIGG

*Attesting Officer*

*Commissioner of Patents and Trademarks*